US008038183B2

(12) United States Patent
Atkinson et al.

(10) Patent No.: US 8,038,183 B2
(45) Date of Patent: Oct. 18, 2011

(54) MULTI-POINT LOCK ASSEMBLY

(76) Inventors: Grant Atkinson, Georgetown (CA); Joseph Chaung, Mississauga (CA)

( * ) Notice: Subject to any disclaimer, the term of this patent is extended or adjusted under 35 U.S.C. 154(b) by 0 days.

(21) Appl. No.: 11/944,678

(22) Filed: Nov. 26, 2007

(65) Prior Publication Data

US 2009/0134634 A1 May 28, 2009

(51) Int. Cl.
*E05C 19/10* (2006.01)
*E05C 19/12* (2006.01)

(52) U.S. Cl. ..... 292/24; 292/26; 292/97; 292/DIG. 46; 292/DIG. 60

(58) Field of Classification Search ..... 292/6, 22, 292/24, 26, 27, 48, 51, 56, 95–97, 113, 116, 292/117, 196, 199, 280, DIG. 46, 25, 28–31, 292/39, 49, 102, 112; 70/91, 95, 100, 224
See application file for complete search history.

(56) References Cited

U.S. PATENT DOCUMENTS

| | | | | |
|---|---|---|---|---|
| 131,321 | A * | 9/1872 | Wright | 292/51 |
| 3,342,516 | A * | 9/1967 | Morand | 292/6 |
| 5,820,170 | A * | 10/1998 | Clancy | 292/26 |
| 6,264,252 | B1 * | 7/2001 | Clancy | 292/196 |
| 6,672,632 | B1 * | 1/2004 | Speed et al. | 292/25 |
| 6,776,441 | B2 * | 8/2004 | Liu | 292/26 |
| 7,040,671 | B2 * | 5/2006 | Su et al. | 292/24 |
| 2004/0145189 | A1 * | 7/2004 | Liu | 292/24 |
| 2004/0195841 | A1 * | 10/2004 | Liu et al. | 292/24 |
| 2006/0091679 | A1 * | 5/2006 | Tsai | 292/24 |

* cited by examiner

*Primary Examiner* — Carlos Lugo
*Assistant Examiner* — Alyson M Merlino
(74) *Attorney, Agent, or Firm* — Elias Borges

(57) ABSTRACT

The present invention is an improved multi-point door latch. The door latch is for mounting in a stile of a door and for latching to a corresponding keeper mounted in a corresponding door jamb. The multi-point door latch includes a housing containing first and second gears, each gear being rotatably mounted to the housing, the gears intermeshing to rotate in opposite directions between first and second positions. One of the gears is mountable to a door lock lever to rotate in response to movement of the door lock lever. The door latch also includes a first and second hook pivotally mounted to the housing, each hook being movable between a latching position for engaging the keeper and a non-latching position. The door latch also includes an actuator coupling the first and second hooks to the first and second gears, respectively. The actuator permits the hooks to move between their latching and non-latching positions in response to the rotation of the gears between their first and second positions, respectively.

4 Claims, 10 Drawing Sheets

MULTI-POINT LOCK ASSEMBLY

FIELD OF THE INVENTION

The invention relates generally to multi-point lock assemblies for sliding doors and windows.

BACKGROUND OF THE INVENTION

In a typical sliding door installation, a door latch unit having one or more hooked locking members is mounted into stile of a movable door. A keeper unit is mounted into a stationary door jamb. The door is closed by bringing the stile into contact with the jamb and then locked by rotating a door lock lever to cause the locking hooks to extend and engage the corresponding slots in the keeper. To ensure a strong locking relationship between the door jam and the stile of the door, multiple hooks are preferred, hence the term multi-point lock. However, while multi-point lock mechanisms do provide increased security, it is often difficult to lock and unlock these types of locks because only one door lock lever must operate several locking hooks simultaneously. A multi-point door lock assembly having a reduced amount of force required to engage the locking hooks is therefore desirable.

SUMMARY OF THE INVENTION

In accordance with one aspect of the present invention, there is provided an improved multi-point door latch for use with a door lock lever and for mounting in a stile of a door and for latching to a corresponding keeper mounted in a corresponding door jamb, the door latch having improved performance. The multi-point door latch includes a housing containing first and second gears, each gear being rotatably mounted to the housing, the gears intermeshing to rotate in opposite directions between first and second positions. One of the gears is mountable to the door lock lever to rotate in response to movement of the door lock lever. The door latch also includes a pair of first and second hooks pivotally mounted to the housing, each hook being movable between a latching position for engaging the keeper and a non-latching position. The door latch also includes an actuator coupling the first and second hooks to the first and second gears, respectively, and for moving the hooks between their latching and non-latching positions in response to the rotation of the gears between their first and second positions.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
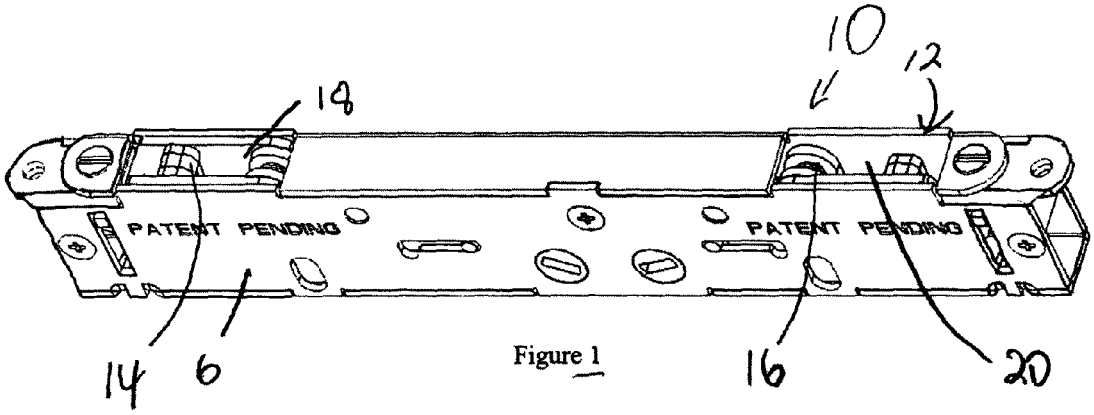
FIG. 1 is a perspective view of a multi-point lock assembly made in accordance with the present invention showing the locking cams de-energized and in their fully up position.
Figure 2:
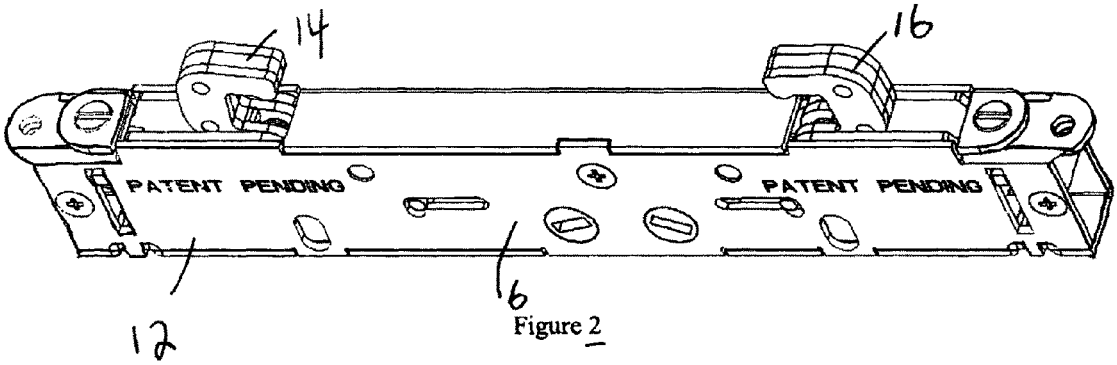
FIG. 2 is a perspective view of the lock assembly shown in FIG. 1 showing the locking cams energized and in their fully up position.
Figure 3:
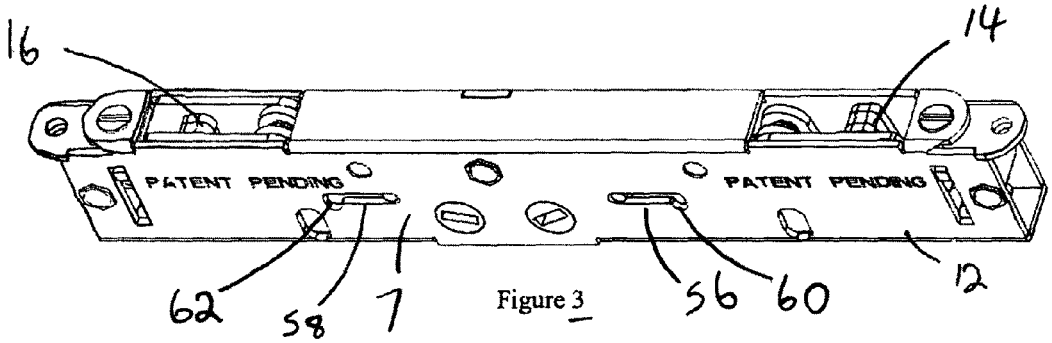
FIG. 3 is a perspective view of the lock assembly shown in FIG. 1 showing the opposite side of the lock assembly and showing the locking cams de-energized and in their fully up position.
Figure 4:
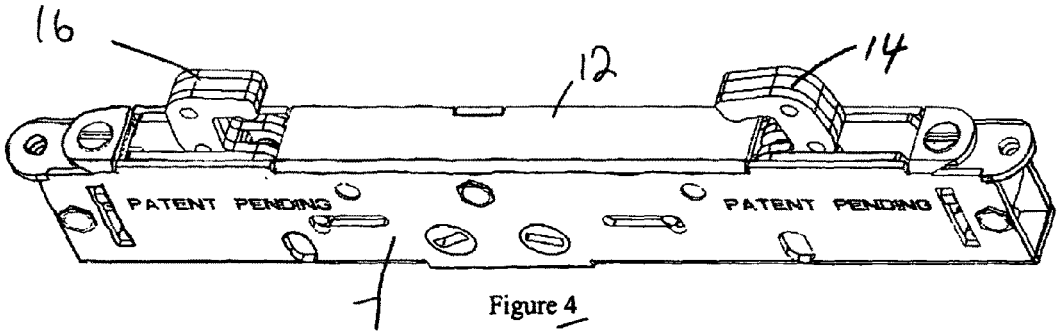
FIG. 4 is a perspective view of the lock assembly shown in FIG. 1 showing the opposite side of the lock assembly and showing the locking cams energized and in their fully up position.
Figure 5:
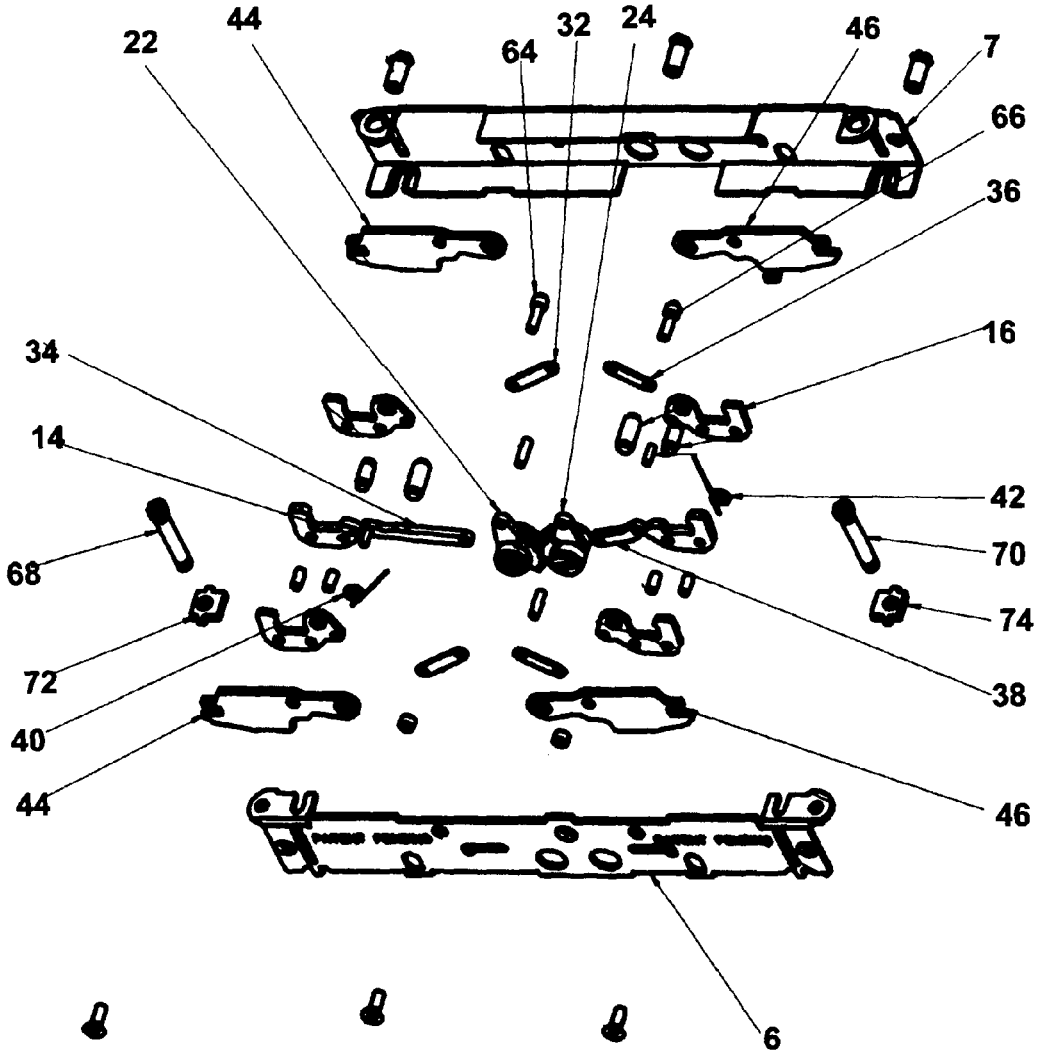
FIG. 5 is an exploded view of the lock assembly shown in FIG. 1.

Referring firstly to FIGS. 1 thorough 4, the present invention, shown generally as item 10, consists of a housing 12 having hooks 14 and 16 pivotally attached therein. Hooks 14 and 16 are movable between a latching position, as shown in FIGS. 2 and 4 and a non-latching position as shown in FIGS. 1 and 3. Housing 12 is preferably made from two stamped steel lock plates namely front plate 6 and rear plate 7. Apertures 18 and 20 are formed on the housing 12 to permit hooks 14 and 16 to extend there through when the hooks are in their latched position.

Figure 6:
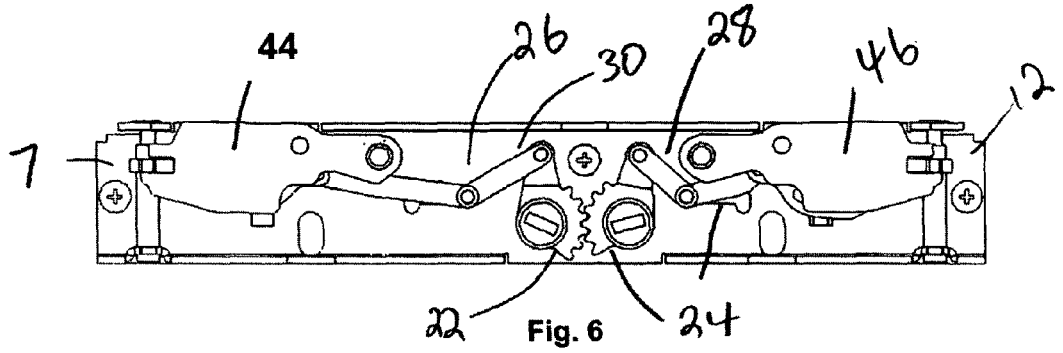
FIG. 6 is a front plan view of the lock assembly of FIG. 1 with the front panel removed and showing the locking cams de-energized and in the fully up position.
Figure 7:
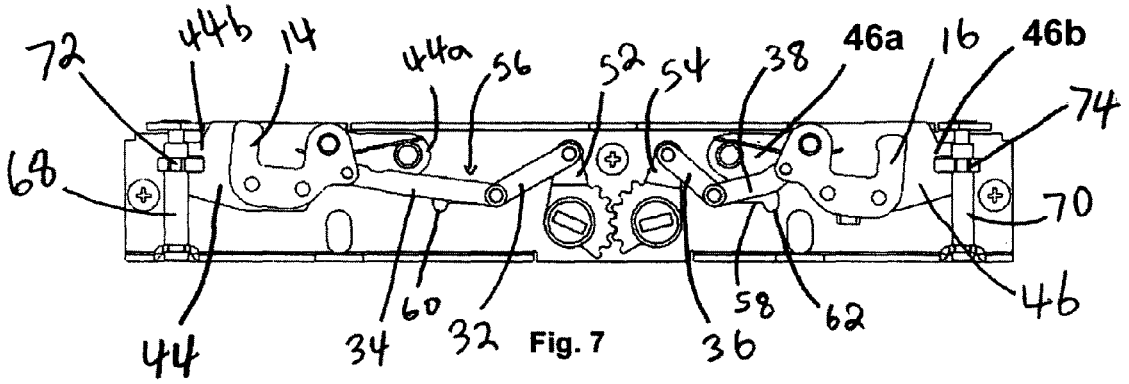
FIG. 7 is a front plan view of the lock assembly as shown in FIG. 6 with the lock cam guide plates removed and showing the locking cams de-energized and in the fully up position.
Figure 8:
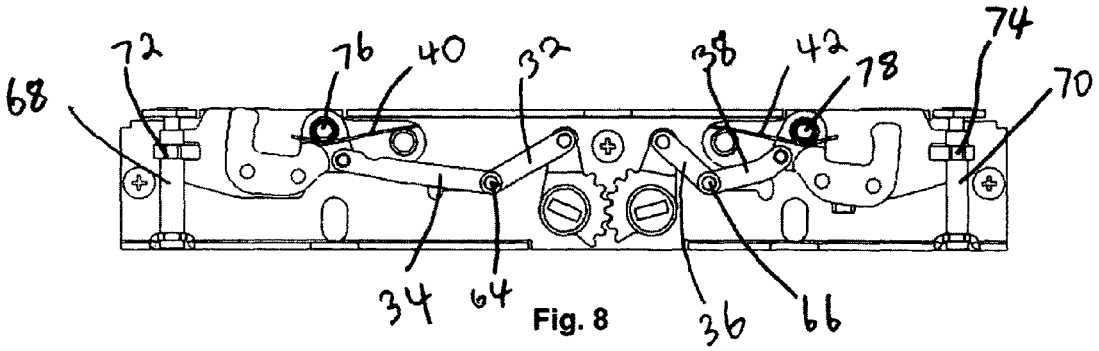
FIG. 8 is a front plan view of the lock assembly as shown in FIG. 7 partly disassembled to show the spring in a de-energized state and showing the locking cams in the fully up position.
Figure 9:
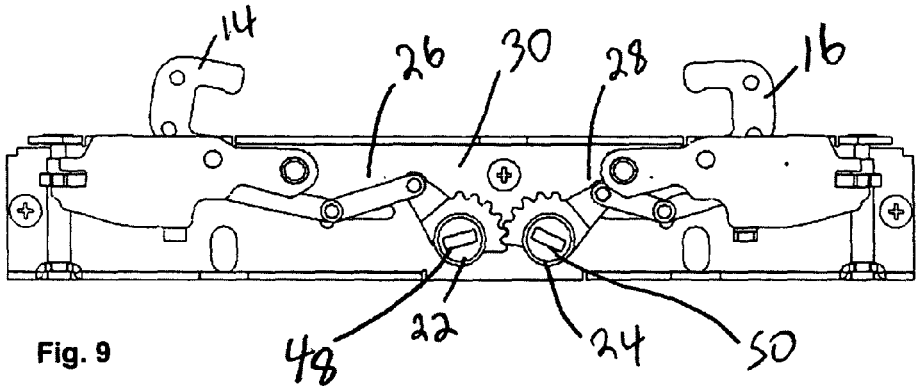
FIG. 9 is a front plan view of the lock assembly of FIG. 1 with the front panel removed and showing the locking cams energized and in the fully up position.
Figure 10:
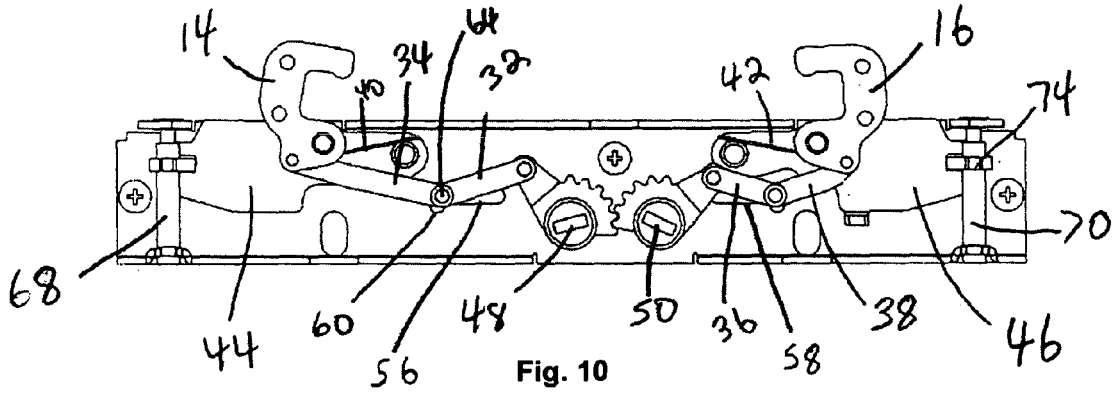
FIG. 10 is a front plan view of the lock assembly as shown in FIG. 6 with the lock cam guide plates removed and showing the locking cams energized and in the fully up position.
Figure 11:
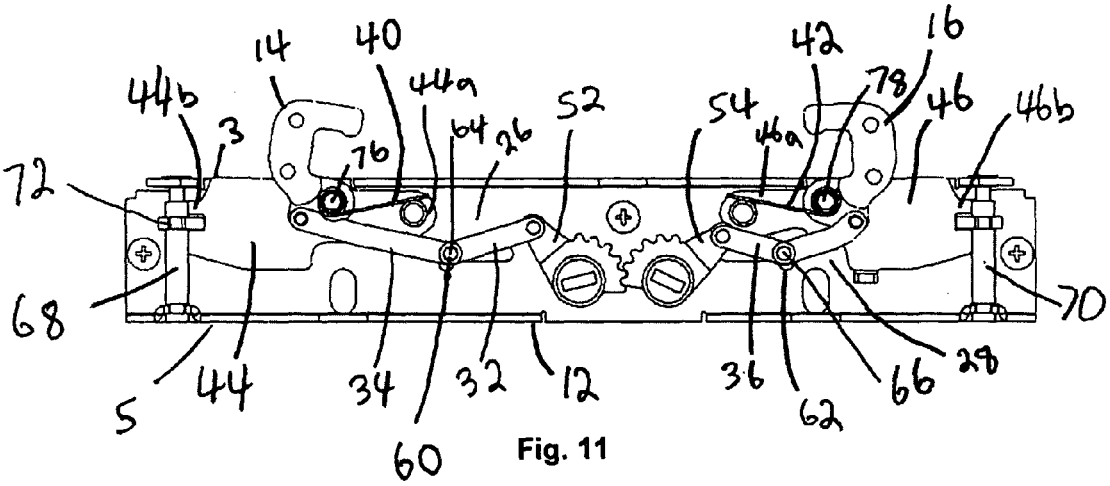
FIG. 11 is a front plan view of the lock assembly as shown in FIG. 7 partly disassembled to show the spring in an energized state and showing the locking cams in the fully up position.
Figure 12:
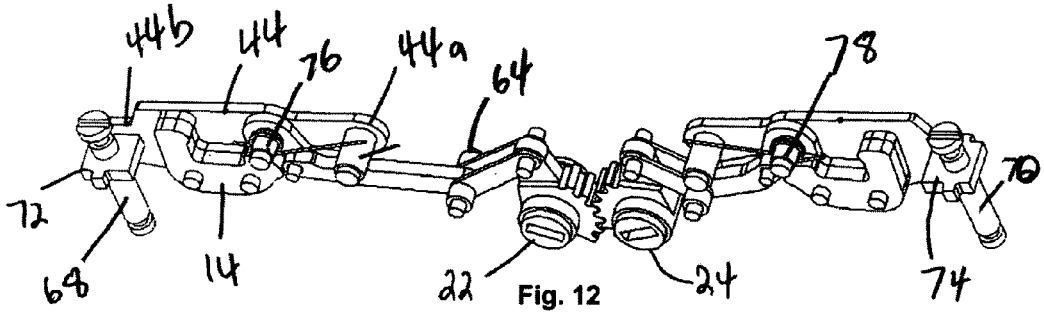
FIG. 12 is a perspective view of the lock assembly of FIG. 1 partly disassembled and showing the locking cams de-energized and in the fully up position.
Figure 13:
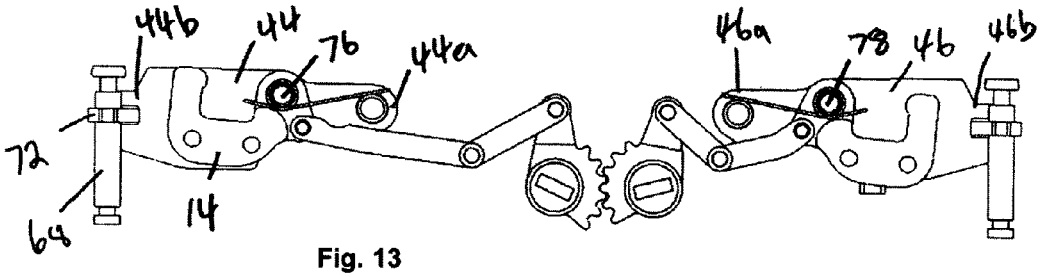
FIG. 13 is a front plan view of the lock assembly shown in FIG. 12.
Figure 14:
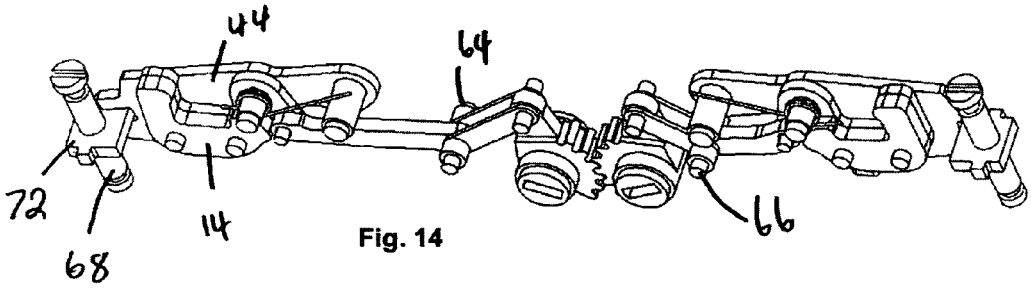
FIG. 14 is a perspective view of the lock assembly of FIG. 1 partly disassembled and showing the locking cams de-energized and in a level position.
Figure 15:
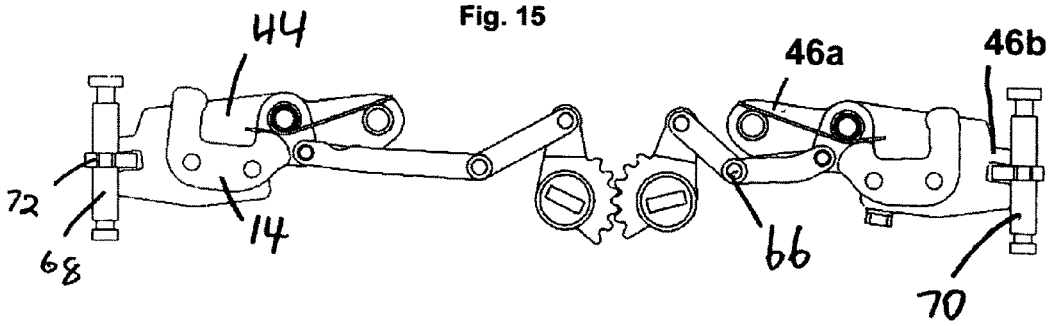
FIG. 15 is a front plan view of the lock assembly shown in FIG. 14.
Figure 16:
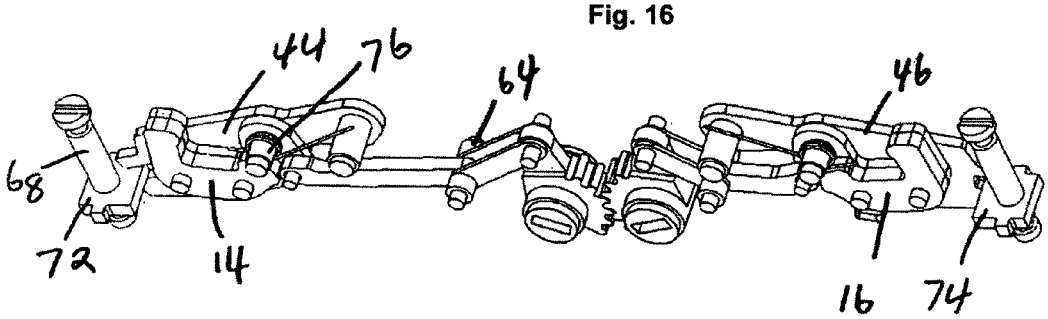
FIG. 16 is a perspective view of the lock assembly of FIG. 1 partly disassembled and showing the locking cams de-energized and in the fully down position.
Figure 17:
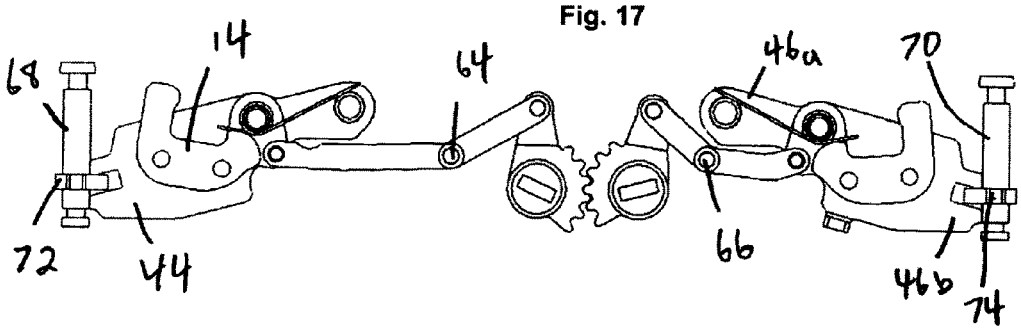
FIG. 17 is a front plan view of the lock assembly shown in FIG. 16.
Figure 18:
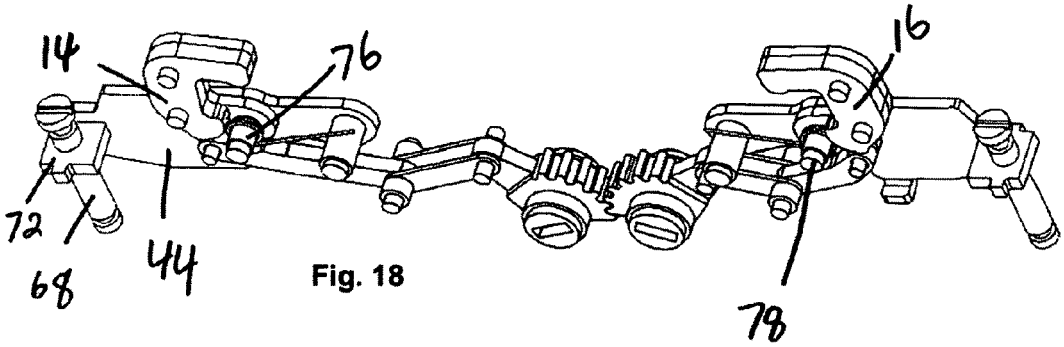
FIG. 18 is a perspective view of the lock assembly of FIG. 1 partly disassembled and showing the locking cams energized and in the fully up position.
Figure 19:
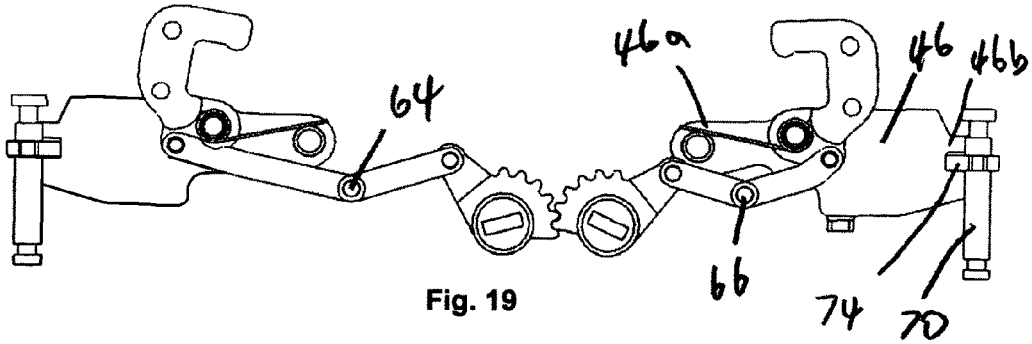
FIG. 19 is a front plan view of the lock assembly shown in FIG. 18.
Figure 20:
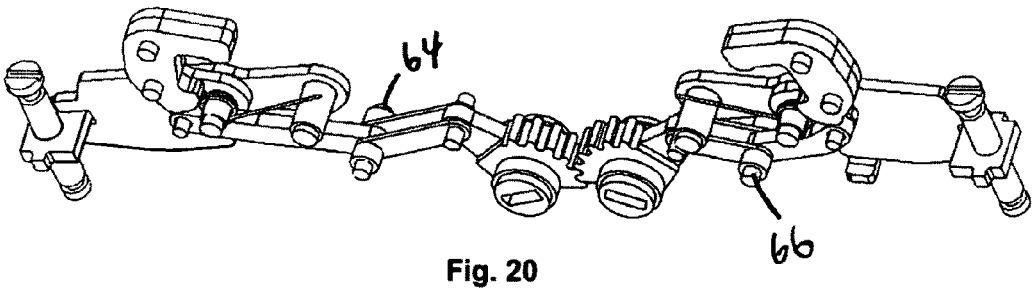
FIG. 20 is a perspective view of the lock assembly of FIG. 1 partly disassembled and showing the locking cams energized and in the level position.
Figure 21:
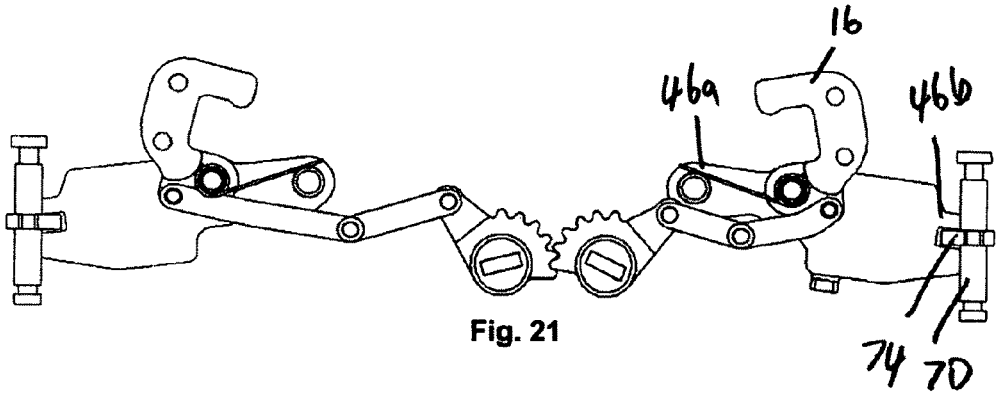
FIG. 21 is a front plan view of the lock assembly shown in FIG. 21.
Figure 22:
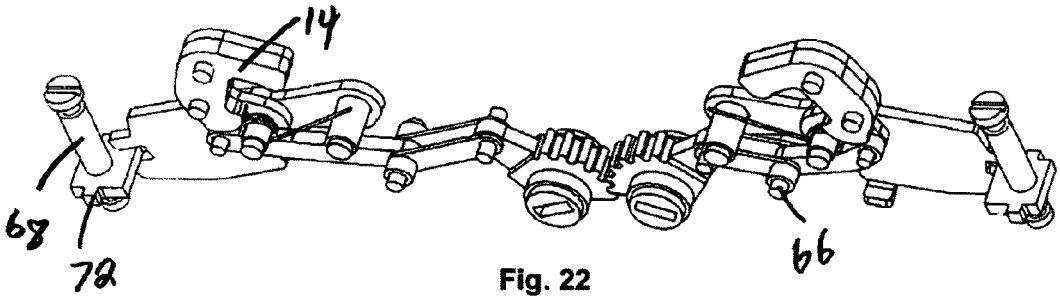
FIG. 22 is a perspective view of the lock assembly of FIG. 1 partly disassembled and showing the locking cams energized and in the fully down position.
Figure 23:
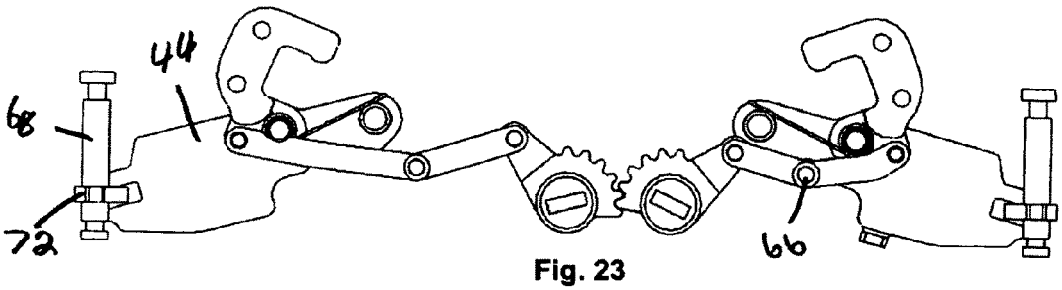
FIG. 23 is a front plan view of the lock assembly shown in FIG. 22.
Figure 24:
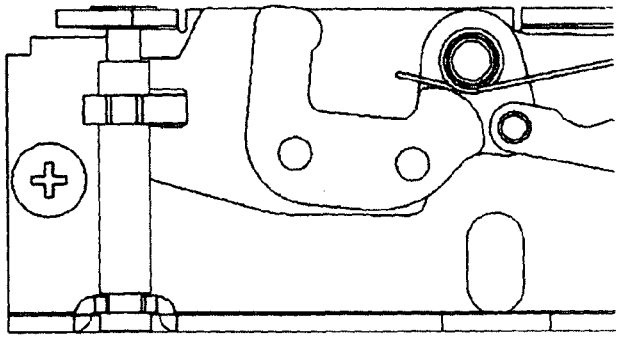
FIG. 24 is a front plan view of a the lock assembly of FIG. 1 partly disassembled and showing the locking cam in a de-energized state and in a fully up position.
Figure 25:
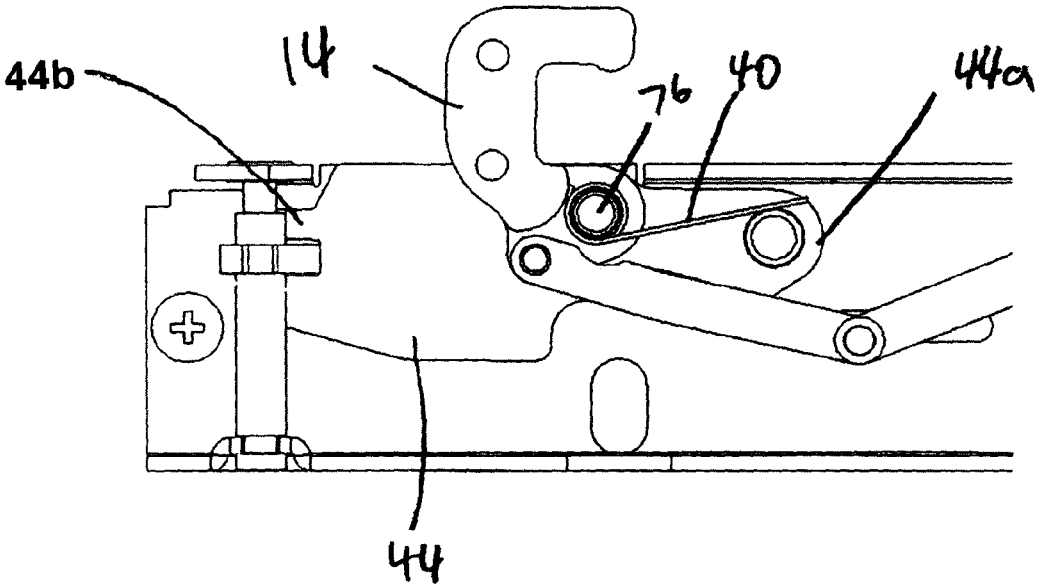
FIG. 25 is a front plan view of the lock assembly of FIG. 1 partly disassembled and showing the locking cam in an energized state and in a fully up position.
Figure 26:
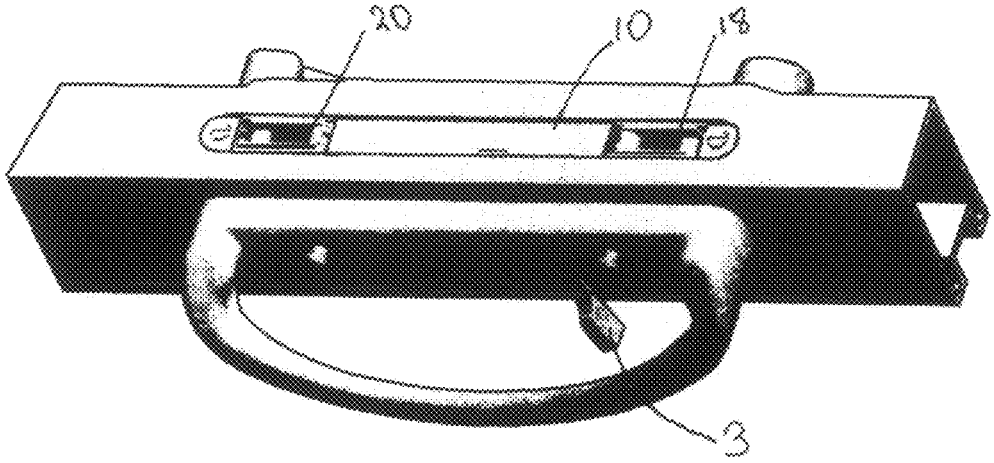
FIG. 26 is a perspective view showing the lock assembly mounted in the stile of the door and showing the locking hooks in a fully retracted non-latching position.

Referring now to FIGS. 6 through 11, intermeshing gears 22 and 24 are rotatably mounted to housing 12 and coupled to hooks 14 and 16, respectively, via actuator 30. Intermeshing gears 22 and 24 are rotatably movable between a first position, as shown in FIGS. 9 through 11 and a second position as shown in FIGS. 6 through 8. Since gears 22 and 24 are intermeshed, they rotate simultaneously in opposite directions between their first and second positions. Gears 22 and 24 are provided with ports 48 and 50, respectively, which are configured to mount to one end of a lock lever 3 (FIG. 26 shows lock lever 3). Gears 22 and 24 can be rotated between their first and second positions simply by turning the lock lever. Gears 22 and 24 have cam portions 52 and 54, respectively, for engaging actuator 30. Actuator 30 is configured to simultaneously move hooks 14 and 16 in opposite directions between their latching and non-latching positions as gears 22 and 24 are moved between their first and second positions, respectively.

Actuator 30 preferably consists of articulated link arms 26 and 28, each of which has opposite ends, one end being attached to the cam portion of a gear and the opposite end being attached to a hook. Link arm 26 consists of push rods 32 and 34 pivotally connected to one another while link arm 28 consists of push rods 36 and 38 pivotally coupled to each other. Push arm 32 is pivotally coupled to cam portion 52 of gear 22 while push rod 34 is pivotally attached to hook 14. Likewise, push rod 36 is pivotally coupled to cam portion 54 of gear 24 and push rod 38 is pivotally coupled to hook 16. Link pin 64 couples push rods 34 and 32 together and also engages elongated groove 56 formed in back plate 7 of housing 12 in a sliding fashion to permit the smooth operation of link arm 26. Likewise, link pin 66 couples push rods 36 and 38 together and also engages elongated groove 58 formed in back plate 7 of housing 12, also in a sliding fashion to permit the smooth operation of link arm 26.

Hooks 14 and 16 are pivotally coupled to housing 12 via support plates 44 and 46 and pins 76 and 78, respectively. Support plate 44 consists of a substantially flat member made of stamped steel having opposite ends 44*a* and 44*b*. End 44*a* is pivotally coupled to housing 12 while end 44*b* is coupled to screw 68 via first nut 72 which is threaded onto screw 68. Screw 68 is mounted to housing 12. Rotating screw 68 is in turn rotatably mounted to housing 12. Nut 72 is threaded to screw 68 such that rotating the screw causes support plate 44 and hook 14 to be moved between an extended position, as shown in FIGS. 6 to 13 and FIGS. 18 to 19 to a retracted position, as shown in FIGS. 16 to 17 and FIGS. 22 to 23. Likewise, support plate 46 consists of a substantially flat member made of stamped steel having opposite ends 46*a* and 46*b*. End 46*a* is pivotally coupled to housing 12 while end 46*b* is coupled to screw 70 via second nut 74 which is threaded onto screw 70. Screw 70 is mounted to housing 12. Screw 70 is in turn rotatably mounted to housing 12. Nut 74 is threaded to screw 70 such that rotating the screw causes support plate 46 and hook 16 to be moved between an extended position, as shown in FIGS. 6 to 13 and FIGS. 18 to 19 to a retracted position, as shown in FIGS. 16 to 17 and FIGS. 22 to 23. By adjusting screws 68 and 70, the exact placement of hooks 14 and 16, respectively, can be adjusted. As best seen in FIG. 11, screws 68 and 70 each have opposite first and second ends, the first ends being secured to upper face 3 of housing 12 and the second ends being secured to lower face 5 of housing 12.

Referring back to FIGS. 6 through 11, hooks 14 and 16 are biased towards their retracted position by springs 40 and 42, respectively. Groove 56 has a stop end 60 which is configured to receive link pin 64 and hold the pin at stop 60 when gears 22 and 24 are in their first position and hook 14 is in its fully latched position. Likewise, groove 58 has a stop end 62 which is configured to receive link pin 66 and hold the link pin at stop 62 when the gears are in their first position and hook 16 is in its fully latched position. The lengths of push rods 34, 32, 36 and 38 are selected such that when gears 22 and 24 are moved back towards their second position, link arms 26 and 28 pull link pins 64 and 66 out of stops 60 and 62, respectively. Again referring to FIG. 11, torsion springs 40 and 42 are coupled to hooks 14 and 16 and plates 44 and 46, respectively, such that the torsion springs bare against the hooks directly and also urge link arms 34 and 36, respectively, downward such that pins 64 and 66 are urged towards stops 60 and 62, respectively.

The present invention has several advantages over the prior art. Firstly, by using a pair of intermeshing gears in combination with a pair of articulated link arms to move the hooks between their latching and non-latching positions, the user requires relatively little torque to be applied to the lock lever in order lock or unlock the door. Furthermore, by using biasing springs to bias hooks towards their unlatching positions, it is possible to ensure that the door will be fully unlocked when the user engages the door lock lever to unlock the door.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A multi-point door latch for mounting in a stile of a door and for latching to a corresponding keeper mounted in a corresponding door jamb, the door latch being mountable to a door lock lever, the multi-point door latch comprising:

a housing containing first and second gears, each gear being rotatably mounted to the housing, the gears intermeshing to rotate in opposite directions between first and second positions, at least one of said gears being mountable to the door lock lever to rotate in response to movement of the door lock lever;

first and second hooks pivotally mounted to the housing, each hook being movable between a latching position for engaging the keeper and a non-latching position;

a first and second articulated link arm for coupling the first and second hooks, respectively to the first and second gears, respectively, and for moving the hooks between their latching and non-latching positions in response to the rotation of the gears between their first and second positions;

a first and second groove formed on the housing adjacent the first and second articulated link arms, respectively, each of the articulated link arms having a link pin projecting there from which is slidingly retained in each of the grooves, each groove being dimensioned and configured to steady the movement of the link arms as the gears move between their first and second positions;

a first and second stop formed on the first and second grooves, respectively, the first and second stops being positioned on the grooves at a point on the grooves corresponding to the position of the link pins when the hooks are in their latching position, the stops being dimensioned and configured to retain the link pins within the stops, the link arms being dimensioned and configured such that when the gears are moved from their first position towards their second position the link pins are pulled out of the stops and;

first and second torsion springs for biasing the first and second hooks towards their non-latching positions, the first and second torsion springs pressing directly on the first and second hooks, respectively and biasing the link pins away from the stops, and wherein the first torsion spring is mounted to a support plate of the first guide assembly and the second torsion spring is mounted to a support plate of a second guide assembly.

2. The multi-point door latch of claim 1 wherein the first and second guide assemblies being movably mounted to the housing, the first and second-hooks-being pivotally mounted to the first and second guide-assemblies, respectively, each of the guide assemblies being selectively movable between an extended position wherein the guide assemblies positions the hooks closer to an upper face of the housing and a refracted position wherein the guide assemblies positions the hooks further away from the upper face.

3. The multi-point door latch of claim 2 wherein the first and second guide assemblies each comprise the support plates having opposite first and second ends, the first end of said support plates being pivotally coupled to the housing at a position between the hook and the gears and the second end of each support plate being coupled to a nut of a screw mounted on the housing and extending from the upper face to a lower face of the housing, the second end of each support plate being coupled to the screw such that support plate can be moved between extended and retracted positions by rotation of the screw such that the guide assemblies are placed in their extended and retracted positions.

4. The multi-point door latch of claim 3 wherein each of the screws have opposite ends, one of said ends being mounted to the upper face of the housing and the other of said ends being mounted to the lower face of the housing.

* * * * *